US005447200A

United States Patent [19]

Dedora et al.

[11] Patent Number: 5,447,200

[45] Date of Patent: Sep. 5, 1995

[54] METHOD AND APPARATUS FOR DOWNHOLE SAND CLEAN-OUT OPERATIONS IN THE PETROLEUM INDUSTRY

[76] Inventors: Garth Dedora, 52 Glenpatrick Rd., Cochraue, Alta. T0L 0W3; James F. Wilkin, 2880 - 64th Avenue, Edmonton, Alberta, both of Canada; Michael Wawrzynowski, 6723 - 20th Avenue, Edmonton, Alberta, Canada, T6K 2H1

[21] Appl. No.: 245,572

[22] Filed: May 18, 1994

[51] Int. Cl.[6] ..... E21B 21/00

[52] U.S. Cl. ..... 166/311; 166/105; 166/312

[58] Field of Search ..... 166/312, 311, 105, 68, 166/68.5

[56] References Cited

U.S. PATENT DOCUMENTS

| | | | |
|---|---|---|---|
| 3,249,054 | 5/1966 | Hill | 166/68 |
| 4,091,631 | 5/1978 | Cherrington | 175/62 X |
| 4,671,359 | 6/1987 | Renfro | 166/312 |
| 4,744,426 | 5/1988 | Reed | 175/102 |
| 4,940,092 | 7/1990 | Ferguson et al. | 166/311 |
| 5,086,842 | 2/1992 | Cholet | 166/312 |
| 5,158,140 | 10/1992 | Ferry | 166/312 |
| 5,230,388 | 7/1993 | Cherrington | 166/312 X |

*Primary Examiner*—Hoang C. Dang
*Attorney, Agent, or Firm*—Kent & Edgar

[57] ABSTRACT

A device to be connected to the lower end of a tubing string for removing sand or other debris from oil producing formations below a surface, the device comprising a combination of a thrust and rotational bearing assembly, a rotationally driven downhole pump comprising a rotor and a stator to provide hydraulic energy to lift fluid to the surface, a transfer chamber secured to the pump providing fluid communication between the pump and the tubing string to direct fluid from the pump to enter the string, a nose section secured to the pump rotor and constructed so that sand is mixed with wellbore fluid, a guide to take the mixture to the pump and an anti-rotation device secured to the pump constructed so as to prevent rotation of the pump stator while allowing axial movement of the pump.

18 Claims, 3 Drawing Sheets

METHOD AND APPARATUS FOR DOWNHOLE SAND CLEAN-OUT OPERATIONS IN THE PETROLEUM INDUSTRY

BACKGROUND OF THE INVENTION

The present invention relates to a device and method for use in the petroleum industry for downhole sand clean-out operations.

Certain oil producing formations contain unconsolidated sand and other debris which can be produced with the oil. The sand and debris can collect on the wellbore, reducing the flow area and restricting production rates. In order to restore the well to maximum capacity, the sand must be removed.

Existing sand clean-out methods include the following:

(1) STROKE PUMPS—Stroke pump clean-out tools utilize a large bore reciprocating (stroke) type pump to lift sand laden fluid to surface. These pumps are typically too large to enter the smaller diameter liners encountered at the horizontal section of most wells and must be kept in the larger diameter upper casing string. Since the wells to be cleaned typically do not support a column of fluid to surface and the pump must be submerged, the effective operating range of the pump is between the fluid level and the top of the liner. The actual liner to be cleaned is typically three times longer than this effective range of the pump. In order to clean sand from the entire liner section, the pump must be removed from the well periodically to add more tubing below it to reach farther into the liner. This is a time consuming and hence expensive operation. In most cases, stroke type pumps are only successful in cleaning out the first ⅓ to ½ of the liner section.

(2) CIRCULATING DEVICES—Due to the low fluid level typically encountered in wells to be cleaned out, conventional circulation techniques are not possible. Circulating devices currently in use involve the use of multiple tubing strings (either parallel or concentric) to convey fluid from surface to the sandface and from the sandface back to surface. Moving multiple strings of tubing axially within the wellbore is complicated and expensive. In addition, use of an expensive gel type fluid is typically necessary in such devices in order to carry the relatively heavy sand to surface.

(3) COMBINATION DEVICES—Certain devices that utilize a combination of multiple tubular strings and downhole pumps have been employed with varying degrees of success. These devices are typically slow and expensive to operate for the same reasons as shown above.

Sand clean-out methods incorporating such devices are ineffective and inefficient due to cost, time or capacity limitations.

Downhole rotational pumps are devices which are conventionally used in pumping fluid in oil or gas formations, from a static location in a wellbore.

It is an object of the present invention to provide an apparatus and method which will effectively and economically clean sand and such debris out of such wells.

SUMMARY OF THE INVENTION

In accordance with the present invention there is provided a device to be connected to the lower end of a tubing string, for removing sand or other debris from oil producing formations below a surface. The device comprises a combination of a thrust and rotational bearing assembly, a rotationally driven downhole pump comprising a rotor and a stator to provide hydraulic energy to lift fluid to the surface, a transfer chamber secured to the pump providing fluid communication between the pump and the tubing string to direct fluid from the pump to enter the string, a nose section secured to the pump rotor provided with means for mixing sand with wellbore fluid and means to guide the mixture to the pump and an anti-rotation device secured to the pump constructed so as to prevent rotation of the pump stator while allowing axial movement of the pump.

In a preferred embodiment of the present invention the combination comprises, in sequence from an end to be connected to the string, the thrust and rotational bearing assembly, the transfer chamber, the pump, the anti-rotation device and the nose section. As well it is preferred that the pump be of the progressive cavity type. The nose section is preferably of auger form with a hard exterior surface to resist abrasion and disturb and fluidize sand and debris. It further comprises flexible wire brushes to contact walls of the casing or hole to disturb the sand and debris. The anti-rotation device preferably comprises a plurality of sets of wheels mounted so as to be radially flexible and linearly aligned to rotate in the longitudinal direction, the sets of wheels spaced about its periphery and provided with biasing means to urge the wheels against the walls of the casing or hole so as to resist rotational movement of the device.

In addition, the present invention relates to a method of downhole clean-out for sand and other debris comprising moving a tubing driven, rotationally driven downhole pump axially in a wellbore while pumping. The method further comprises the simultaneous step of dislodging and fluidizing sand and other debris on walls of the wellbore while pumping.

The method and apparatus of the present invention permit effective and economical removal of sand and other debris from wellbores, to increase flow area and improved production rates.

BRIEF DESCRIPTION OF THE DRAWINGS

These and other objects and advantages of the invention will become apparent upon reading the following detailed description and upon referring to the drawings in which.

Figure 1:
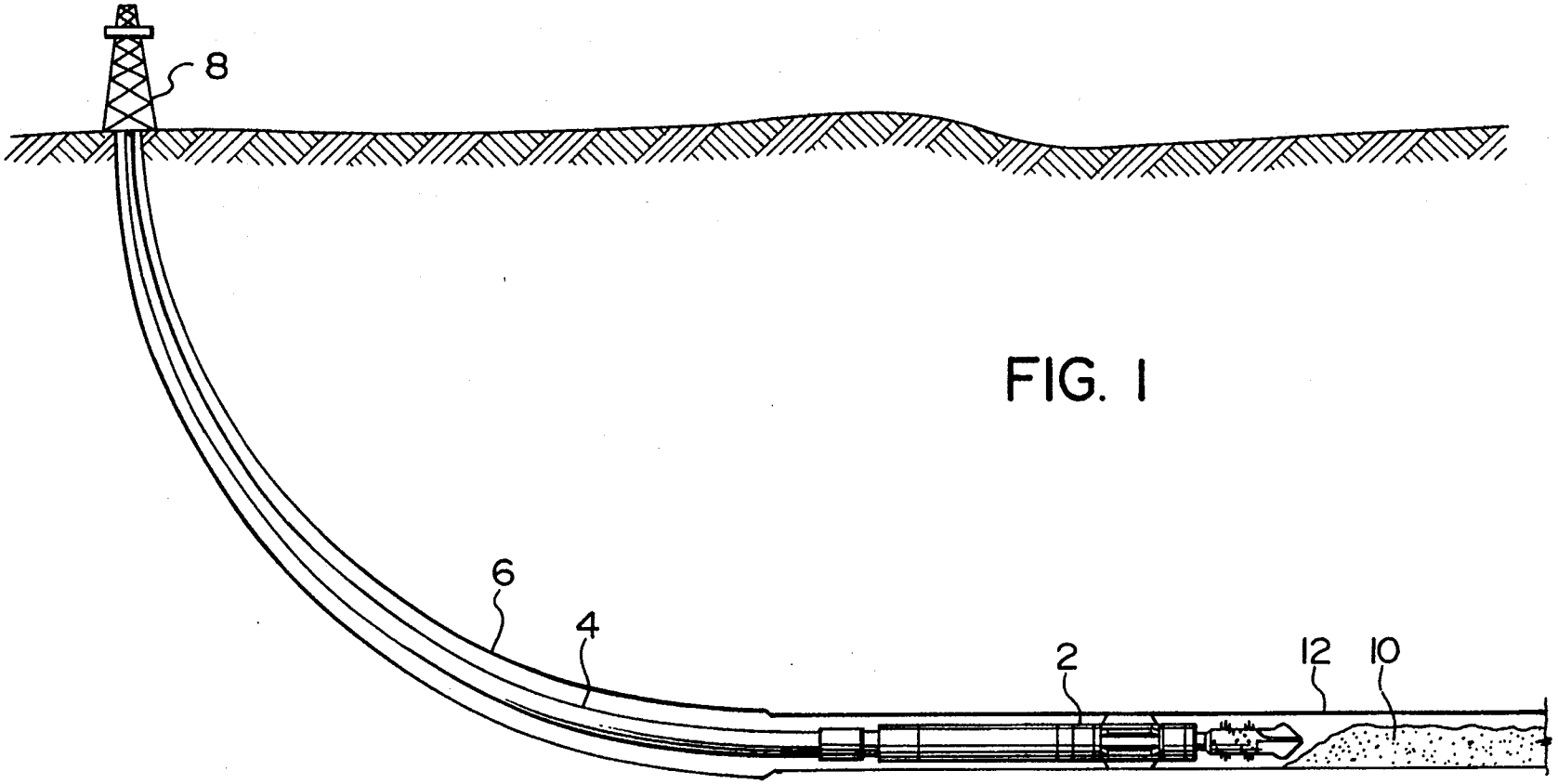
FIG. 1 is a schematic view of a tubing driven pump in accordance with the present invention, pumping in a wellbore while cleaning out sand in accordance with the present invention.
Figure 2A:
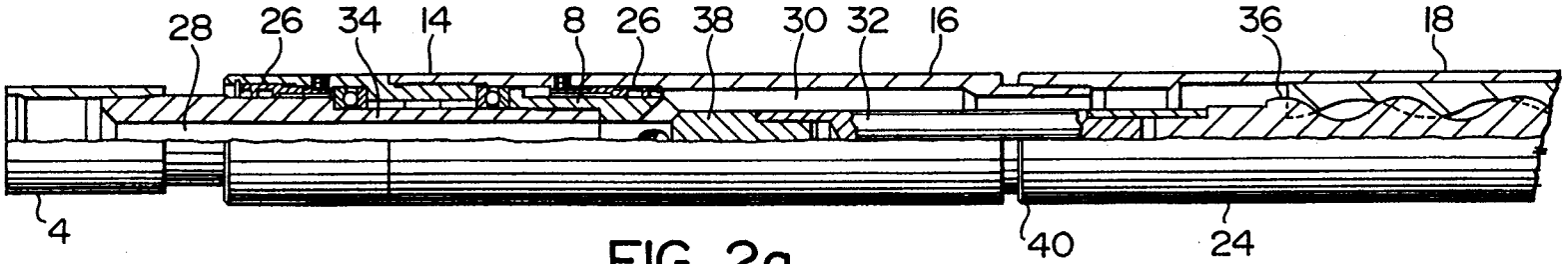
FIG. 2*a* and 2*b* are sides views, in partial section, of the apparatus of the present invention connected to the lower end of a tubing string.
Figure 2B:
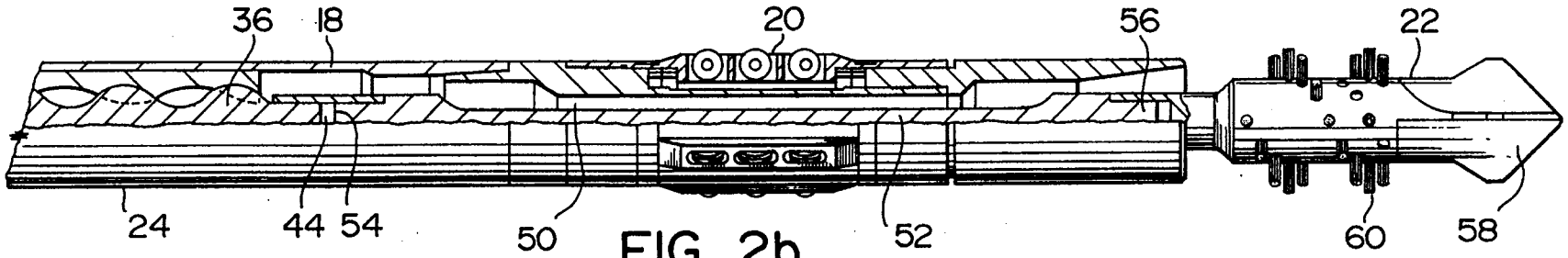
Figure 3:
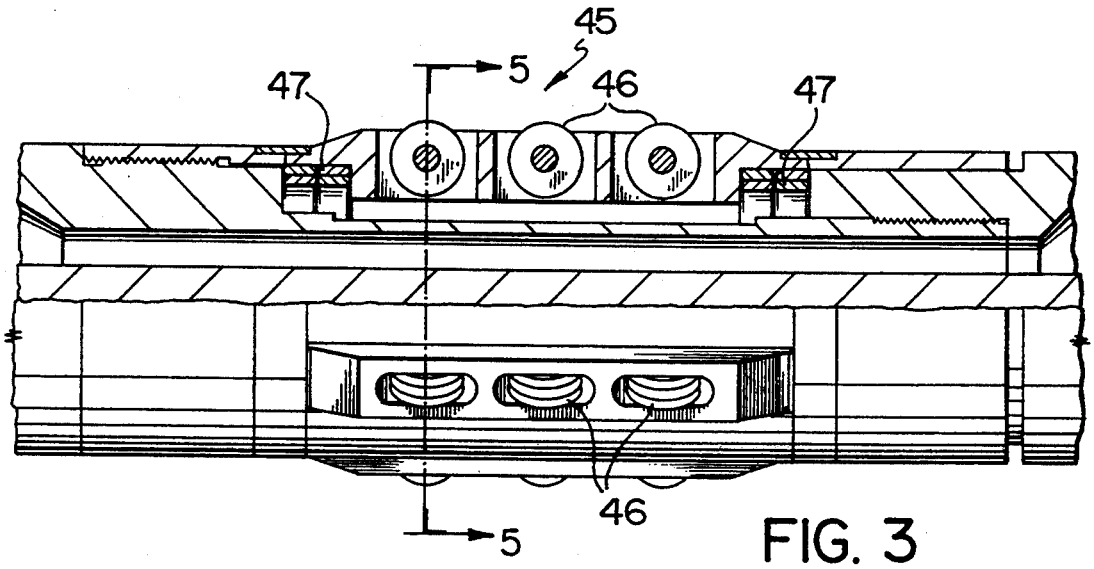
FIG. 3 is a side view, in partial section, of an anti-rotation device, a component of the present invention.
Figure 4:
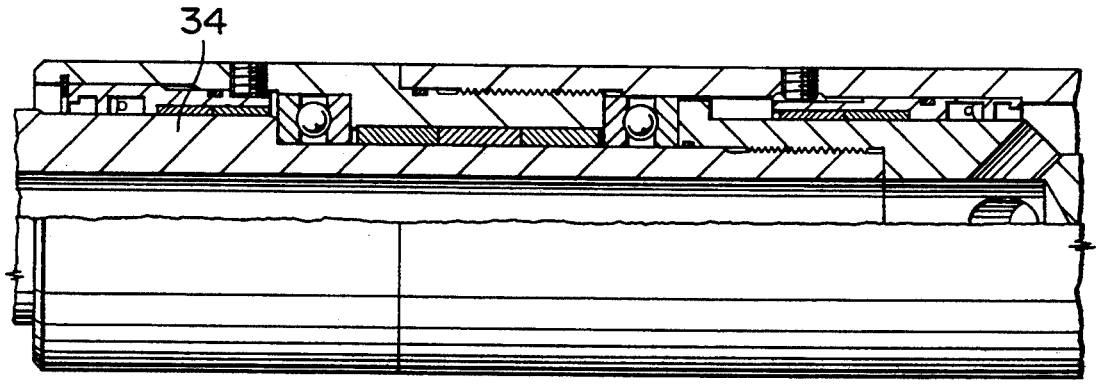
FIG. 4 is a side view, in partial section, of a portion of the bearing assembly, another component of the present invention.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the drawings, similar features have been given similar reference numerals.

Turning to FIG. 1 there is illustrated, in schematic form, a downhole sand clean-out device 2 in accordance with the present invention, which device is secured, as illustrated, to the lower end of tubing 4 operating within casing 6 below a drilling or service rig 8. While the present invention has several different applications, in the illustration it is shown in one of its preferred embodiments, namely for clearing sand 10 from the horizontal production liner 12 of the wellbore.

Device 2, as can be seen in FIGS. *2a* and *2b*, is composed of a number of components arranged in sequence, namely bearing assembly 14, transfer chamber component 16, pump 18, anti-rotation device 20 and nose 22.

Bearing assembly 14 is a fully sealed, oil lubricated system designed to couple the lower end of tubing string 4 to pump stator 24 while accommodating both rotational and thrust loads. Seals 26 prevent extraneous materials from entering fluid passageway 28 extending longitudinally within bearing assembly 14 and communicating between tubing string 4 and chamber 30 of transfer chamber component 16.

Within transfer chamber 30 is a flexible drive shaft 32 which couples the bearing assembly mandrel 34 to the rotor 36 of pump 18. A cross-over sub 38 in part forms the chamber 30, and allows fluid from the discharge end 40 of pump 18, to enter tubing string 4 for transmission to the well head at drilling or service rig 8.

Pump 18 is a rotationally driven downhole pump with rotor 36 and stator 24. This pump provides hydraulic energy to lift fluid within production liner 12 to the surface. The type and size of pump 18 to be used will vary depending upon the fluid to be pumped and the downhole well parameters. It is preferred that this pump be of the progressive cavity type as illustrated.

Figure 5:
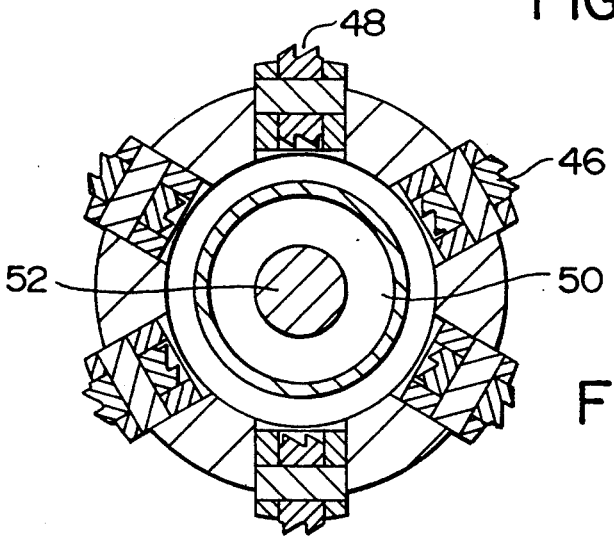
FIG. 5 is a section view along 5—5 of FIG. 3.

Adjacent pump 18, and secured adjacent the pump intake end 44 to stator 24 is anti-rotation device 20. The function of anti-rotation device 20 is to prevent rotation of the pump stator 24 while allowing axial movement of pump 18 within the wellbore 12. This is achieved by its construction comprising a series of sets 45 of wheels 46, the wheels of each set being linearly aligned to rotate in the longitudinal direction. As can be seen in the section view of anti-rotation device 20, in FIG. 5, wheel sets 45 are spaced about the periphery of device 20 and mounted so as to be radially flexible. Each set is provided with appropriate means 47 (e.g. an expansion spring) to urge the wheel sets against the walls of the production liner 12 (or casing) so as to resist rotational movement of the device. As well, the peripheries of wheels 46 are provided with one or more chamfers 48, angled, with respect to the liner or casing wall to provide a directional bite in that wall so as to resist rotative motion of device 20. As can be also seen in FIG. 5, a central cavity 50 is provided within anti-rotation device 20, which cavity is in fluid communication with the intake of pump 18. Within that cavity is a connecting rod 52 which is connected at one end 54 to the pump rotor 36 at its intake end 44 as illustrated (FIG. *2b*). To the other end 56 of connecting rod 50 is secured nose 22, thus connected to the pump rotor. Nose 22 provides the ability to mix sand 10 with wellbore fluid, and guide that mixture of fluid and sand to pump 18. More particularly, this is accomplished with an auger pattern 58 on the free end of nose 22, and wire brushes 60 arranged in an auger pattern as illustrated, to scrape sand and other debris in the wellbore, agitate it and direct the sand—fluid mixture to the intake of pump 18.

In operation, device 2 is connected to a tubular string 4, and lowered into the wellbore to a point in which sand 10 is encountered. The tubing 4 is then rotated, turning the bearing mandrel 34, cross-over sub 38, flexible drive shaft 32, pump rotor 36 and nose 22. The pump stator 24 is held from rotating by anti-rotation device 20, creating pumping action in pump 18. The entire assembly is then advanced in the well bore while rotating. Sand is mixed with well bore fluid (either from the downhole formation or fluid pumped from surface between the wellbore and the tubing) and guided to the pump 18 by nose 22. Hydraulic energy is added to the sand laden fluid by the pump and the fluid is discharged to the transfer chamber device 16. The fluid enters the tubing string through the cross-over sub 38 and is then transmitted to the surface through tubing string 4. Once the well bore has been cleaned, the entire assembly is removed.

It will be understood that the tubing driven pump device 2 in accordance with the present invention offers an efficient method of effectively cleaning the sand out of such wells. It should be understood that the device may be used to clean out any other wellbore debris that may be pumped through the downhole pump. It may also be fitted with a drill bit or mill in order to carry out downhole drilling or milling operations. Moreover, the device according to the present invention may be utilized in open hole (uncased) wellbores.

Thus it is apparent that there has been provided in accordance with the invention that fully satisfies the objects, aims and advantages set forth above. While the invention has been described in conjunction with specific embodiments thereof, it is evident that many alternatives, modifications and variations will be apparent to those skilled in the art in light of the foregoing description. Thus, for example the anti-rotation device 20 might be positioned above pump 18 on the discharge end thereof, or the bearing assembly might be alternatively positioned with respect to the other components of device 2. Accordingly, it is intended to embrace all such alternatives, modifications and variations as fall within the spirit and broad scope of the invention.

What we claim as our invention:

1. A device to be connected to the lower end of a tubing string for removing sand or other debris from oil producing formations below a surface, the device comprising a combination of a thrust and rotational bearing assembly, a rotationally driven downhole pump comprising a rotor and a stator to provide hydraulic energy to lift fluid to the surface, a transfer chamber secured to the pump providing fluid communication between the pump and the tubing string to direct fluid from the pump to enter the string, a nose section secured to the pump rotor provided with means for mixing sand with wellbore fluid and means to guide the mixture to the pump and an anti-rotation device secured to the pump constructed so as to prevent rotation of the pump stator while allowing axial movement of the pump.

2. A device according to claim 1 wherein the combination comprises, in sequence from an end to be connected to the string, the thrust and rotational bearing assembly, the transfer chamber, the pump, the anti-rotation device and the nose section.

3. A device according to claim 1 wherein the pump is of the progressive cavity type.

4. A device according to claim 3 wherein the transfer chamber comprises a flexible drive shaft.

5. A device according to claim 1 wherein the transfer chamber comprises a flexible drive shaft.

6. A device according to claim 1 wherein the nose section for mixing sand with wellbore fluid comprises flexible wire brushes to contact walls of the casing or hole to disturb the sand and debris.

7. A device according to claim 6 wherein the wire brushes are arranged in an helical pattern on an exterior surface of the nose section so as to guide sand laden fluid to a fluid passage of the anti rotation device.

8. A device according to claim 7 wherein the nose section is of auger form and has a hard exterior surface to resist abrasion and disturb and fluidize sand and debris.

9. A device according to claim 3 wherein the nose section for mixing sand with wellbore fluid comprises flexible wire brushes to contact walls of the casing or hole to disturb the sand and debris.

10. A device according to claim 9 wherein the wire brushes are arranged in an helical pattern on an exterior surface of the nose section so as to guide sand laden fluid to a fluid passage of the anti rotation device.

11. A device according to claim 10 wherein the nose section is of auger form and has a hard exterior surface to resist abrasion and disturb and fluidize sand and debris.

12. A device according to claim 1 wherein the anti-rotation device comprises a plurality of sets of wheels mounted so as to be radially flexible and linearly aligned to rotate in the longitudinal direction, the sets of wheels spaced about its periphery and provided with biasing means to urge the wheels against the walls of the casing or hole so as to resist rotational movement of the device.

13. A device according to claim 3 wherein the anti-rotation device comprises a plurality of sets of wheels mounted so as to be radially flexible and linearly aligned to rotate in the longitudinal direction, the sets of wheels spaced about its periphery and provided with biasing means to urge the wheels against the walls of the casing or hole so as to resist rotational movement of the device.

14. A device according to claim 8 wherein the anti-rotation device comprises a plurality of sets of wheels mounted so as to be radially flexible and linearly aligned to rotate in the longitudinal direction, the sets of wheels spaced about its periphery and provided with biasing means to urge the wheels against the walls of the casing or hole so as to resist rotational movement of the device.

15. A device according to claim 9 wherein the anti-rotation device comprises a plurality of sets of wheels mounted so as to be radially flexible and linearly aligned to rotate in the longitudinal direction, the sets of wheels spaced about its periphery and provided with biasing means to urge the wheels against the walls of the casing or hole so as to resist rotational movement of the device.

16. A device according to claim 12 wherein the wheels are provided with chamfered bottoms to resist rotative motion of the anti-rotation device.

17. A method of downhole clean-out for sand and other debris comprising moving a tubing driven, rotationally driven downhole pump, having a stator and a rotor, axially in a wellbore while pumping and holding the stator against rotation while turning the rotor by providing the stator with means in contact with the wellbore to prevent rotational movement of the stator relative to the wellbore while allowing axial movement of the stator within the wellbore.

18. A method according to claim 17 further comprising the simultaneous step of dislodging and fluidizing sand and other debris on walls of the wellbore while pumping.

* * * * *